US007001278B2

(12) United States Patent
Maya et al.

(10) Patent No.: US 7,001,278 B2
(45) Date of Patent: Feb. 21, 2006

(54) GAMING DEVICE HAVING APPARENT AND FINAL AWARDS

(75) Inventors: Darren Maya, Reno, NV (US); Marc Mierau, Reno, NV (US); Ryan W. Cuddy, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 255 days.

(21) Appl. No.: 10/269,427

(22) Filed: Oct. 11, 2002

(65) Prior Publication Data

US 2004/0072615 A1 Apr. 15, 2004

(51) Int. Cl.
*A63F 9/24* (2006.01)

(52) U.S. Cl. ..... 463/26

(58) Field of Classification Search ..... 463/12–13, 463/16–22, 25, 40–42; 273/138.1, 138.2, 273/139, 143 R; 700/91–93
See application file for complete search history.

(56) References Cited

U.S. PATENT DOCUMENTS

| | | | |
|---|---|---|---|
| 4,157,829 | A | 6/1979 | Goldman et al. |
| 4,448,419 | A | 5/1984 | Telnaes |
| 4,494,197 | A | 1/1985 | Troy et al. |

(Continued)

FOREIGN PATENT DOCUMENTS

| | | | |
|---|---|---|---|
| EP | 0874337 | A1 | 10/1998 |
| EP | 0926645 | A2 | 6/1999 |
| EP | 0944030 | A2 | 9/1999 |
| EP | 0945837 | A2 | 9/1999 |
| EP | 0981119 | A2 | 2/2000 |
| EP | 0984408 | A2 | 3/2000 |
| EP | 0984409 | A2 | 3/2000 |
| WO | WO 9732285 | | 9/1997 |
| WO | WO 00/12186 | | 3/2000 |
| WO | WO 00/32286 | * | 6/2000 |

OTHER PUBLICATIONS

The Official Let's Make a Deal Website [http://www.lets-makeadeal.com/showinfo.htm], pps 1–2.*
Party Time Top Dollar Deluxe, copyright 2000, pps 1–2.*
Addams Family Advertisement and Article written by IGT, Strictly Slots, published in 2000.
Adders and Ladders Advertisement written by Barcrest Ltd., published prior to 2000.
American Thunder Screen Shots written by IGT, published in 1998.
Big Bang Piggy Bankin Advertisement written by WMS Gaming, Inc., published prior to 2000.
Blackjack/Twenty–One Description written by Hoyle's Rules of Games, published in 1993.
Bonus Spin Red, White & Blue Advertisement written by IGT, published in 2000.

(Continued)

*Primary Examiner*—Mark Sager
(74) *Attorney, Agent, or Firm*—Bell Boyd & Lloyd LLC

(57) ABSTRACT

The present invention provides a gaming device having a plurality of start values. The player selects one of the start values, as part of a game sequence. During the game sequence, the gaming device increments the start value to an apparent award. The gaming device in one embodiment enables the player to keep the apparent award or trade it for another apparent award. The other apparent award in one embodiment is derived from one of the other start values. After one or more keep or trade sequences, the player achieves one of the apparent awards. The gaming device then performs a sequence in which the apparent award changes into an actual award. The gaming device provides the actual award to the player.

61 Claims, 9 Drawing Sheets

U.S. PATENT DOCUMENTS

| | | | | |
|---|---|---|---|---|
| 4,582,324 | A | | 4/1986 | Koza et al. |
| 4,624,459 | A | | 11/1986 | Kaufman |
| 4,652,998 | A | | 3/1987 | Koza et al. |
| 4,669,730 | A | | 6/1987 | Small |
| 4,689,742 | A | | 8/1987 | Troy et al. |
| 4,695,053 | A | | 9/1987 | Vazquez, Jr. et al. |
| 4,743,022 | A | | 5/1988 | Wood |
| 4,815,741 | A | | 3/1989 | Small |
| 4,817,951 | A | | 4/1989 | Crouch et al. |
| 4,842,278 | A | | 6/1989 | Markowicz |
| 4,856,787 | A | | 8/1989 | Itkis |
| 4,991,848 | A | | 2/1991 | Greenwood et al. |
| 5,042,809 | A | | 8/1991 | Richardson |
| 5,092,598 | A | | 3/1992 | Kamille |
| 5,152,529 | A | | 10/1992 | Okada |
| 5,158,293 | A | | 10/1992 | Mullins |
| 5,178,390 | A | | 1/1993 | Okada |
| 5,205,555 | A | | 4/1993 | Hamano |
| 5,282,620 | A | | 2/1994 | Keesee |
| 5,324,035 | A | | 6/1994 | Morris et al. |
| 5,342,047 | A | | 8/1994 | Heidel et al. |
| 5,397,125 | A | | 3/1995 | Adams |
| 5,407,199 | A | | 4/1995 | Gumina |
| 5,449,173 | A | | 9/1995 | Thomas et al. |
| 5,456,465 | A | | 10/1995 | Durham |
| 5,524,888 | A | | 6/1996 | Heidel |
| 5,536,016 | A | | 7/1996 | Thompson |
| 5,542,669 | A | | 8/1996 | Charron et al. |
| 5,560,603 | A | | 10/1996 | Seelig et al. |
| 5,611,535 | A | | 3/1997 | Tiberio |
| 5,628,684 | A | | 5/1997 | Bouedec |
| 5,674,128 | A | | 10/1997 | Holch et al. |
| 5,711,525 | A | | 1/1998 | Breeding |
| 5,766,074 | A | | 6/1998 | Cannon et al. |
| 5,769,716 | A | | 6/1998 | Saffari et al. |
| 5,772,509 | A | | 6/1998 | Weiss |
| 5,775,692 | A | | 7/1998 | Watts et al. |
| 5,779,544 | A | | 7/1998 | Seelig et al. |
| 5,779,545 | A | | 7/1998 | Berg et al. |
| 5,788,573 | A | | 8/1998 | Baerlocher et al. |
| 5,800,269 | A | | 9/1998 | Holch et al. |
| 5,823,874 | A | | 10/1998 | Adams |
| 5,833,537 | A | | 11/1998 | Barrie |
| 5,833,538 | A | | 11/1998 | Weiss |
| 5,848,932 | A | | 12/1998 | Adams |
| 5,851,148 | A | | 12/1998 | Brune et al. |
| 5,873,781 | A | | 2/1999 | Keane |
| 5,882,261 | A | | 3/1999 | Adams |
| 5,902,184 | A | | 5/1999 | Bennett |
| 5,911,418 | A | | 6/1999 | Adams |
| 5,919,088 | A | | 7/1999 | Weiss |
| 5,944,606 | A | | 8/1999 | Gerow |
| 5,947,820 | A | | 9/1999 | Morro et al. |
| 5,949,042 | A | | 9/1999 | Dietz, II et al. |
| 5,951,397 | A | | 9/1999 | Dickinson |
| 5,964,463 | A | | 10/1999 | Moore, Jr. |
| 5,967,894 | A | | 10/1999 | Kinoshita et al. |
| 5,980,384 | A | | 11/1999 | Barrie |
| 5,984,781 | A | | 11/1999 | Sunaga |
| 5,997,400 | A | | 12/1999 | Seelig et al. |
| 5,997,401 | A | | 12/1999 | Crawford |
| 6,004,207 | A | | 12/1999 | Wilson, Jr. et al. |
| 6,015,346 | A | | 1/2000 | Bennett |
| 6,017,032 | A | | 1/2000 | Grippo et al. |
| 6,019,369 | A | | 2/2000 | Nakagawa et al. |
| 6,024,640 | A | | 2/2000 | Walker et al. |
| 6,033,307 | A | | 3/2000 | Vancura |
| 6,056,642 | A | | 5/2000 | Bennett |
| 6,059,289 | A | | 5/2000 | Vancura |
| 6,059,658 | A | | 5/2000 | Mangano et al. |
| 6,062,980 | A | | 5/2000 | Luciano |
| 6,086,066 | A | | 7/2000 | Takeuchi et al. |
| 6,089,976 | A | | 7/2000 | Schneider et al. |
| 6,089,977 | A | | 7/2000 | Bennett |
| 6,089,978 | A | | 7/2000 | Adams |
| 6,089,982 | A | | 7/2000 | Holch et al. |
| 6,093,102 | A | | 7/2000 | Bennett |
| 6,102,400 | A | | 8/2000 | Scott et al. |
| 6,102,798 | A | | 8/2000 | Bennett |
| 6,120,031 | A | | 9/2000 | Adams |
| 6,126,541 | A | | 10/2000 | Fuchs |
| 6,126,542 | A | | 10/2000 | Fier |
| 6,142,873 | A | | 11/2000 | Weiss et al. |
| 6,142,874 | A | | 11/2000 | Kodachi et al. |
| 6,142,875 | A | | 11/2000 | Kodachi et al. |
| 6,146,272 | A | | 11/2000 | Walker et al. |
| 6,146,273 | A | | 11/2000 | Olsen |
| 6,159,095 | A | | 12/2000 | Frohm et al. |
| 6,159,096 | A | | 12/2000 | Yoseloff |
| 6,159,097 | A | | 12/2000 | Gura |
| 6,159,098 | A | | 12/2000 | Slomiany et al. |
| 6,162,121 | A | | 12/2000 | Morro et al. |
| 6,168,520 | B1 | | 1/2001 | Baerlocher et al. |
| 6,168,521 | B1 | | 1/2001 | Luciano et al. |
| 6,168,523 | B1 | | 1/2001 | Piechowiak et al. |
| 6,173,955 | B1 | | 1/2001 | Perrie et al. |
| 6,174,233 | B1 | | 1/2001 | Sunaga et al. |
| 6,174,235 | B1 | | 1/2001 | Walker et al. |
| 6,183,361 | B1 | | 2/2001 | Cummings et al. |
| 6,190,254 | B1 | | 2/2001 | Bennett |
| 6,190,255 | B1 | * | 2/2001 | Thomas et al. ..... 463/25 |
| 6,203,429 | B1 | | 3/2001 | Demar et al. |
| 6,210,275 | B1 | | 4/2001 | Olsen |
| 6,210,276 | B1 | | 4/2001 | Mullins |
| 6,210,279 | B1 | | 4/2001 | Dickinson |
| 6,213,876 | B1 | | 4/2001 | Moore, Jr. |
| 6,220,961 | B1 | | 4/2001 | Keane et al. |
| 6,224,482 | B1 | | 5/2001 | Bennett |
| 6,224,483 | B1 | | 5/2001 | Mayeroff |
| 6,231,442 | B1 | | 5/2001 | Mayeroff |
| 6,231,445 | B1 | | 5/2001 | Acres |
| 6,241,606 | B1 | | 6/2001 | Riendeau et al. |
| 6,261,177 | B1 | | 7/2001 | Bennett |
| 6,261,178 | B1 | | 7/2001 | Bennett |
| 6,270,409 | B1 | | 8/2001 | Shuster |
| 6,280,328 | B1 | | 8/2001 | Holch et al. |
| 6,290,600 | B1 | | 9/2001 | Glasson |
| 6,302,790 | B1 | | 10/2001 | Brossard |
| 6,305,686 | B1 | | 10/2001 | Perrie et al. |
| 6,309,298 | B1 | | 10/2001 | Gerow |
| 6,309,300 | B1 | | 10/2001 | Glavich |
| 6,312,334 | B1 | * | 11/2001 | Yoseloff ..... 463/25 |
| 6,328,649 | B1 | | 12/2001 | Randall et al. |
| 6,346,043 | B1 | | 2/2002 | Colin et al. |
| 6,347,996 | B1 | | 2/2002 | Gilmore et al. |
| 6,358,151 | B1 | | 3/2002 | Enzminger et al. |
| 6,364,766 | B1 | | 4/2002 | Anderson et al. |
| 6,375,187 | B1 | | 4/2002 | Baerlocher |
| 6,398,218 | B1 | | 6/2002 | Vancura |
| 6,413,160 | B1 | | 7/2002 | Vancura |
| 6,419,583 | B1 | | 7/2002 | Crumby et al. |
| 6,443,837 | B1 | | 9/2002 | Jaffe et al. |
| 6,494,785 | B1 | | 12/2002 | Gerrard et al. |
| 6,506,118 | B1 | | 1/2003 | Baerlocher et al. |
| 6,514,141 | B1 | | 2/2003 | Kaminkow et al. |
| 6,524,184 | B1 | | 2/2003 | Lind et al. |
| 6,533,664 | B1 | | 3/2003 | Crumby |
| 6,537,150 | B1 | | 3/2003 | Luciano et al. |
| 6,569,015 | B1 | | 5/2003 | Baerlocher et al. |
| 6,572,473 | B1 | | 6/2003 | Baerlocher |
| 6,575,830 | B1 | | 6/2003 | Baerlocher et al. |

| | | | |
|---|---|---|---|
| 6,582,306 | B1 | 6/2003 | Kaminkow |
| 6,589,114 | B1 | 7/2003 | Rose |
| 6,599,192 | B1 | 7/2003 | Baerlocher et al. |
| 6,605,002 | B1 | 8/2003 | Baerlocher |
| 6,609,974 | B1 | 8/2003 | Mead et al. |
| 6,632,141 | B1 | 10/2003 | Webb et al. |
| 6,769,961 | B1 | 8/2004 | Kistler et al. |
| 2002/0072402 | A1 | 6/2002 | Baerlocher |
| 2002/0072404 | A1 | 6/2002 | Gerow |
| 2002/0098882 | A1 | 7/2002 | Lind et al. |
| 2002/0142822 | A1 | 10/2002 | Baerlocher et al. |
| 2002/0155883 | A1 | 10/2002 | Baerlocher |
| 2002/0183109 | A1 | 12/2002 | McGahn et al. |
| 2003/0040360 | A1 | 2/2003 | Kaminkow |
| 2003/0045348 | A1 | 3/2003 | Palmer et al. |
| 2003/0045350 | A1 | 3/2003 | Baerlocher et al. |
| 2003/0060260 | A1 | 3/2003 | Gerrard et al. |
| 2003/0064795 | A1 | 4/2003 | Baerlocher et al. |
| 2003/0078093 | A1 | 4/2003 | Simms et al. |
| 2003/0078096 | A1 | 4/2003 | Kaminkow et al. |
| 2003/0087693 | A1 | 5/2003 | Baerlocher et al. |
| 2003/0119583 | A1 | 6/2003 | Kaminkow et al. |
| 2003/0157982 | A1 | 8/2003 | Gerrard et al. |
| 2003/0162578 | A1 | 8/2003 | Baerlocher et al. |
| 2003/0162584 | A1 | 8/2003 | Hughs-Baird et al. |
| 2003/0195027 | A1 | 10/2003 | Baerlocher et al. |
| 2003/0199310 | A1 | 10/2003 | Kaminkow |
| 2004/0077403 | A1 | 4/2004 | Maya et al. |

OTHER PUBLICATIONS

Bonus Times Article written by Strictly Slots, published in 2000.

By George Advertisement, written by IGT, published in 2002.

Caribbean Gold II Advertisement written by Aristocrat Incorporated, published in 1998.

Cash Box Advertisement & Article written by Anchor Games, Strictly Slots, published in 2000.

Chutes & Ladders Game Instructions written by Hasbro–Milton Bradley, published in 1999.

Description of Let's Make a Deal Television Show written by letsmakeadeal.com (2 pages), printed on Mar. 16, 2001.

Double Diamond Game Descriptions written by IGT printed on Mar. 21, 2001.

Double Up Poker Game Description written by IGT Undated.

Easy Street Advertisements and Articles written by Casino Data Systems, published in 2000.

Elvis Advertisement written by IGT, published in 1999.

Empire Game Advertisement written by AC Coin, published in 1996.

Fire and Fortune Article written by Strictly Slots, published in 2001.

Fox "N" Hound Advertisement written by IGT, published in 2000.

In Between Game Description written by IGT, available prior to 2000.

Jackpot Party Advertisements and Articles written by WMS Gaming, Inc., published in 1998.

Keep Your Hat On Advertisement written by Aristocrat, published in 2001.

Let's Make a Deal written by geocities.com (10 pages), printed on Mar. 21, 2001.

Let's Make a Deal written by fortunecity.com (4 pages), printed on Mar. 21, 2001.

Let's Make a Deal written by Illinoislottery.com (1 page), printed on Mar. 21, 2001.

Let's Make a Deal geocities.com (2 pages), printed on Mar. 16, 2001.

Let's Make A Deal Advertisement written by Shuffle Master and IGT, published in 2001.

Let's Make a Deal Game Advertisement written by Bally Gaming Systems, published in 1999.

Little Green Men Advertisement and Article written by IGT, Strictly Slots, published in 2000.

MegaJackpots Advertisement written by IGT, published in 1998.

Money Grab Article written by Strictly Slots, published in Apr. 2001.

Money in the Bank Advertisement written by Strictly Slots Konami, published in 2001.

Monopoly Advertisements and Articles written by WMS Gaming, Inc., Strictly Slots, published in 1998, 1999, 2000.

Monopoly Party Train Article written by Strictly Slots, published in 2002.

Neon Nights written by IGT, published in 2000.

On the Money Article written by Strictly Slots, Casino Data Systems, published in Dec. 2000.

Polly & Roger Advertisement written by VLC, Inc., published in 2000.

Price is Right "Cliff Hangers" Description written by www.geocities.com; members.aol.com (web site), printed Mar. 21, 2001.

Price is Right "Showcases" Description written by schuminweb.com (web site), printed Mar. 16, 2001.

Psycho Cash Beast Club (including knockouts) written by Barcrest, published prior to 1998.

Richard Petty Advertisement written by IGT, published in 2000.

South Park—Dodgeball Advertisement written by IGT, published in 2000.

Spell Binder Advertisement written by IGT, published in 2000.

Sphinx Advertisement written by Atronic Casino Technology, Ltd., published in 1997.

Take Your Pick Article written by Strictly Slots, published in Mar. 2001.

Take Your Pick Advertisement written by IGT/Anchor Gaming, published in 1999.

Texas Tea Advertisement written by IGT, published in 2000.

The Deals of Let's Make a Deal written by fortunecity.com (2 pages), printed on Mar. 16, 2001.

The Official Let's Make a Deal Website written by Bally Gaming System Website, printed on Mar. 16, 2001.

Top Cat Advertisement written by WMS Gaming, Inc., published prior to 2000.

Top Dollar Game Advertisement written by IGT, published in 1998.

Totem Pole Advertisement written by IGT, published in 1997.

Treasure Wheel/Treasure Tunnel Advertisement written by Sigma Game, Inc., published prior to 2000.

Wheel of Fortune Advertisement written by IGT, published in 1998.

Wheel of Fortune Advertisement written by IGT, published in 1999.

Wheel Poker Article written by Strictly Slots (Anchor Games), published in Nov. 2000.

Winning Streak Web Site Description written by WMS Gaming Inc. (web site), printed on Mar. 21, 2001.

X Factor Advertisement and Website Page written by WMS Gaming, Inc., published in 1998.

Diamonopoly Advertisement by International Gamco, Inc., published 2002.

Electronic Pull Tabs Advertisement by 21st Century Gaming, published prior in 2002.

Lucky Times California Lottery Newsletter published 1996.

Instant Winner Advertisement by Williams/WMS Gaming, published prior to 2002.

Play it again Advertisement by International Gamco, Inc., published 2000.

International Gaming & Wagering Business (IGWB), Mar. 1997, pp. 11–18.

* cited by examiner

GAMING DEVICE HAVING APPARENT AND FINAL AWARDS

CROSS REFERENCE TO RELATED APPLICATIONS

The present invention relates to the following co-pending commonly owned U.S. patent applications: "GAMING DEVICE HAVING BONUS SCHEME WITH INCREMENTAL VALUE DISCLOSURE," Ser. No. 09/627,198, now U.S. Pat. No. 6,582,306; "GAMING DEVICE HAVING TEASE REVEAL FEATURE," Ser. No. 09/957,583, now U.S. Pat. No. 6,605,002; "GAMING DEVICE HAVING SEPARATELY CHANGEABLE VALUE AND MODIFIER BONUS SCHEME," Ser. No. 09/626,045, now U.S. Pat. No. 6,569,015; "GAMING DEVICE HAVING A BONUS ROUND WITH MULTIPLE RANDOM AWARD GENERATION AND MULTIPLE RETURN/RISK SCENARIOS," Ser. No. 09/678,989, "GAMING DEVICE HAVING AN AWARD EXCHANGE BONUS ROUND AND METHOD FOR REVEALING AWARD EXCHANGE POSSIBILITIES," Ser. No. 09/689,510, "GAMING DEVICE HAVING GRADUATING AWARD EXCHANGE SEQUENCE WITH A TEASE CONSOLATION SEQUENCE AND AN INITIAL QUALIFYING SEQUENCE," Ser. No. 09/680,601, "GAMING DEVICE HAVING A DESTINATION PURSUIT BONUS SCHEME WITH ADVANCED AND SETBACK CONDITIONS," Ser. No. 09/686,409, now U.S. Pat. No. 6,494,785; "GAMING DEVICE HAVING VALUE SELECTION BONUS," Ser. No. 09/684,605, now U.S. Pat. No. 6,541,141; "GAMING DEVICE HAVING RISK EVALUATION BONUS ROUND," Ser. No. 09/688,434, now U.S. Pat. No. 6,599,192; "GAMING DEVICE HAVING AN IMPROVED OFFER/ACCEPTANCE BONUS SCHEME," Ser. No. 09/966,884, "GAMING DEVICE HAVING IMPROVED OFFER AND ACCEPTANCE BONUS SCHEME," Ser. No. 09/680,630, now U.S. Pat. No. 6,375,187; "GAMING DEVICE HAVING IMPROVED AWARD OFFER BONUS SCHEME," Ser. No. 09/682,368, now U.S. Pat. No. 6,506,118; "GAMING DEVICE HAVING OFFER ACCEPTANCE GAME WITH TERMINATION LIMIT," Ser. No. 09/822,711, "GAMING DEVICE HAVING OFFER/ACCEPTANCE ADVANCE THRESHOLD AND LIMIT BONUS SCHEME," Ser. No. 09/838,014, "GAMING DEVICE HAVING AN OFFER AND ACCEPTANCE SELECTION BONUS SCHEME WITH A TERMINATOR AND AN ANTI-TERMINATOR," Ser. No. 09/945,082, now U.S. Pat. No. 6,632,141; "GAMING DEVICE HAVING AN AWARD OFFER AND TERMINATION BONUS SCHEME," Ser. No. 09/682,428, "GAMING DEVICE HAVING IMPROVED OFFER AND ACCEPTANCE BONUS SCHEME," Ser. No. 10/074,273, "GAMING DEVICE HAVING AN OFFER/ACCEPTANCE GAME WHEREIN EACH OFFER IS BASED ON A PLURALITY OF INDEPENDENTLY GENERATED EVENTS," Ser. No. 10/244,134, "GAMING DEVICE HAVING A DESTINATION PURSUIT BONUS SCHEME WITH ADVANCED AND SETBACK CONDITIONS," Ser. No. 10/288,750, "GAMING DEVICE HAVING IMPROVED AWARD OFFER BONUS SCHEME," Ser. No. 10/290,800, "GAMING DEVICE HAVING VALUE SELECTION BONUS," Ser. No. 10/306,295, "GAMING DEVICE HAVING IMPROVED AWARD OFFER BONUS SCHEME," Ser. No. 10/318,752, "GAMING DEVICE HAVING A DESTINATION PURSUIT BONUS SCHEME WITH ADVANCED AND SETBACK CONDITIONS," Ser. No. 10/393,201, "GAMING DEVICE HAVING VALUE SELECTION BONUS," Ser. No. 10/354,514, "GAMING DEVICE HAVING SEPARATELY CHANGEABLE VALUE AND MODIFIER BONUS SCHEME," Ser. No. 10/410,019, "GAMING DEVICE HAVING BONUS SCHEME WITH INCREMENTAL VALUE DISCLOSURE," Ser. No. 10/447,779, "GAMING DEVICE HAVING RISK EVALUATION BONUS ROUND," Ser. No. 10/616,563, "GAMING DEVICE HAVING RISK EVALUATION BONUS ROUND," Ser. No. 10/454,337, "GAMING DEVICE HAVING TEASE REVEAL FEATURE," Ser. No. 10/623,268, "GAMING DEVICE HAVING BONUS SCHEME WITH INCREMENTAL VALUE DISCLOSURE AND VALUE MODIFICATION," Ser. No. 10/661,209, and "GAMING DEVICE HAVING A DESTINATION PURSUIT BONUS SCHEME WITH ADVANCED AND SETBACK CONDITIONS," Ser. No. 10/660,075.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a gaming device. More particularly, the present invention relates to a gaming device having player selectable awards.

Gaming devices provide enjoyment and excitement to players, in part, because they may ultimately lead to monetary awards for the players. Gaming devices also provide enjoyment and excitement to the players because they are fun to play. Secondary or bonus games, in particular, provide gaming device manufacturers with the opportunity to add enjoyment and excitement to that which is already expected from a primary or base game of the gaming device. Secondary or bonus games provide extra awards to the player and enable the player to play a game that is different than the primary or base game.

Gaming devices are typically games of luck, not skill. Primary games are set up to pay back a certain average percentage of the amount of money wagered. The average payout percentage in most primary games is set high enough that any player who plays a few hands or spins of the reels will win. That is, in most primary games, it is not too difficult to experience some level of success. Bonus games are typically set up for the player to succeed. The player usually wins an award in a bonus game. In bonus game play, the goal is often to maximize the possible award.

One known secondary game provides a player with a series of offers, where each offer includes a number of credits, coins, tokens or dollars. The player may accept or reject each offer prior to the final offer. The offers are randomly determined from a series of potential offers of differing values. If the player accepts an offer, the game provides the offer to the player. If the player rejects an offer, the gaming device provides another offer to the player, as long as the current offer is not the final offer. The player is automatically provided the final offer. This type of gaming device has achieved significant popularity in the gaming industry.

As part of a continuing need to provide gaming devices that issue primary game and secondary game awards in an exciting and enjoyable manner, it is desirable to have variability in game play as well as outcomes and potential payouts. This may be more or less possible depending on the type of machine and the desired winning percentage. It is therefore desirable to provide a primary or secondary game of a gaming device having relatively flat and predictable actual payouts, and which also has variable outcomes and varying levels of success.

SUMMARY OF THE INVENTION

The present invention provides a gaming device. More particularly, the present invention provides a processor controlled gaming device having a memory device storing a game program, wherein the processor operates with the game program to yield player selectable apparent awards. When the player selects one of the apparent awards, the gaming device changes the selected apparent award to a predetermined actual award and awards the actual award to the player.

In one embodiment, the gaming device includes a plurality of start values. The player selects one of the start values as part of a game sequence. During the game sequence, the gaming device increments the start value to an apparent award. In one embodiment, the gaming device enables the player to keep the apparent award or trade it for another apparent award. In one embodiment, the other apparent award is derived from one of the other start values. After one or more accept or reject or keep or trade sequences, the player achieves one of the apparent awards. The gaming device then performs a sequence in which the achieved or selected apparent award changes into an actual award. The gaming device provides the actual award to the player.

The gaming device provides a plurality of apparent awards. Each apparent award is derived through the game sequence from one of the plurality of start values. In one embodiment, the gaming device associates each start award/apparent award with an actual award. Each actual award is achievable by the player if the player selects the associated apparent award. The apparent award changes and in one embodiment increases to form the associated actual award.

In one embodiment, the player chooses the start value. In another embodiment, the processor randomly generates the start value. In one embodiment, the player through one or more accept or reject or keep or trade sequences chooses the apparent award and the associated actual award. In another embodiment, the processor randomly chooses one or more accept or reject or keep or trade sequences to determine the apparent value and the associated actual award.

The gaming device can provide none, one or any number of keep or trade sequences. Certain keep or trade sequences may offer the player a lower award in exchange. This is intended to entertain the player.

In one embodiment, the gaming device stores a number of pools or databases in a memory device accessible by the processor. One pool or database contains the start values. One pool or database contains the actual awards and one pool or database includes a set of incremental values. The processor of the gaming device randomly selects a number of start values and does not display them to the player. The player chooses one of the start values by picking one of a plurality of selections. The gaming device then sequentially increments the selected start value by randomly generating incremental values from the incremental value pool if the incremented start value falls below a threshold value.

In one embodiment, the threshold value is one of the generated actual awards less an offset. In one embodiment, the actual award used to determine the threshold value is the smallest generated actual award. In this way, each actual award is assured to be larger than each apparent award. In one embodiment, the memory device also stores an offset pool wherein the gaming device generates differing offset values.

In one embodiment, the gaming device continues to increment the player selected start value until the incremented start value meets or exceeds the threshold value. Also, the gaming device in one embodiment uses a likelihood percentage, which enables the start value to increment, such as seventy-five percent of the time. Thus, in one embodiment, the values increment until the threshold is reached or the percentage outcome dictates that the start value no longer increments. The player then receives the last properly incremented value as an apparent award.

The gaming device performs the above described incrementing procedure with the other start values. The gaming device may at various increments offer the player an option to trade the currently held apparent award for an incremented start value or for another apparent award. Eventually, the gaming device runs out of start values to increment and the player is left with one of the apparent awards.

In one embodiment, the gaming device changes and increases the apparent award to an actual award via an adjustment sequence. The adjustment sequence in one embodiment reveals the actual award associated with each apparent award. The player can thereby see which of the apparent awards the player should have chosen. It is likely that the apparent award that would have yielded the largest associated actual award is not in fact the largest apparent award. In one embodiment of the present invention, the player's success in establishing the apparent awards and the keep or trade options does not affect the player's success in obtaining the largest actual award, the outcome is completely random and unknown to the player.

It is therefore an advantage of the present invention to provide a gaming device that has variability in game play.

Another advantage of the present invention is to provide a gaming device that has variability in game outcomes.

Moreover, an advantage of the present invention is to provide a gaming device that has variability in apparent payouts.

Still further, an advantage of the present invention is to provide a gaming device that has non-predictable actual payouts.

Additional features and advantages of the present invention are described in, and will be apparent from, the following Detailed Description of the Invention and the figures.

DETAILED DESCRIPTION OF THE INVENTION

Figure 1A:
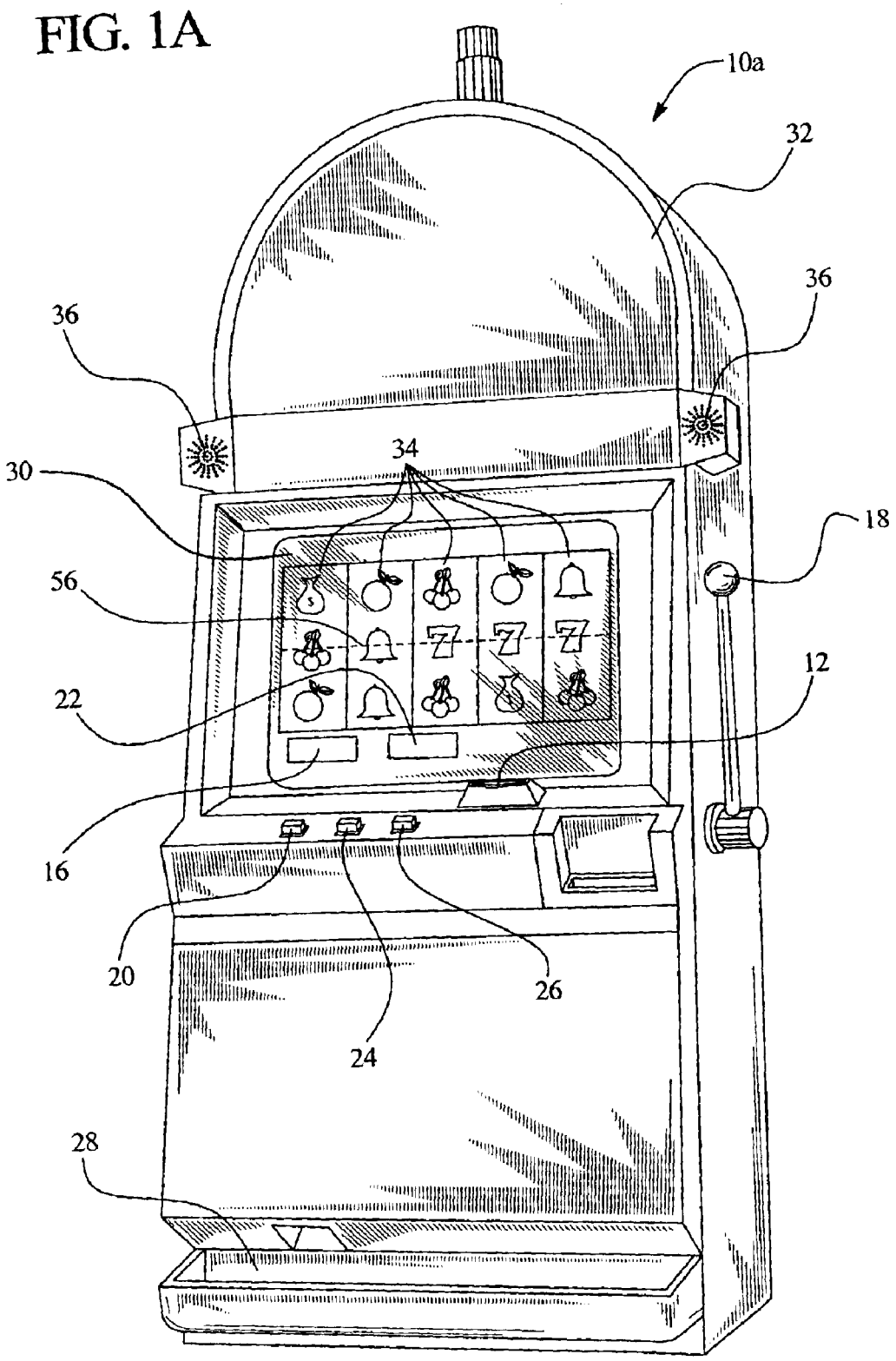
FIGS. 1A and 1B are perspective views of alternative embodiments of the gaming device of the present invention.
Figure 1B:
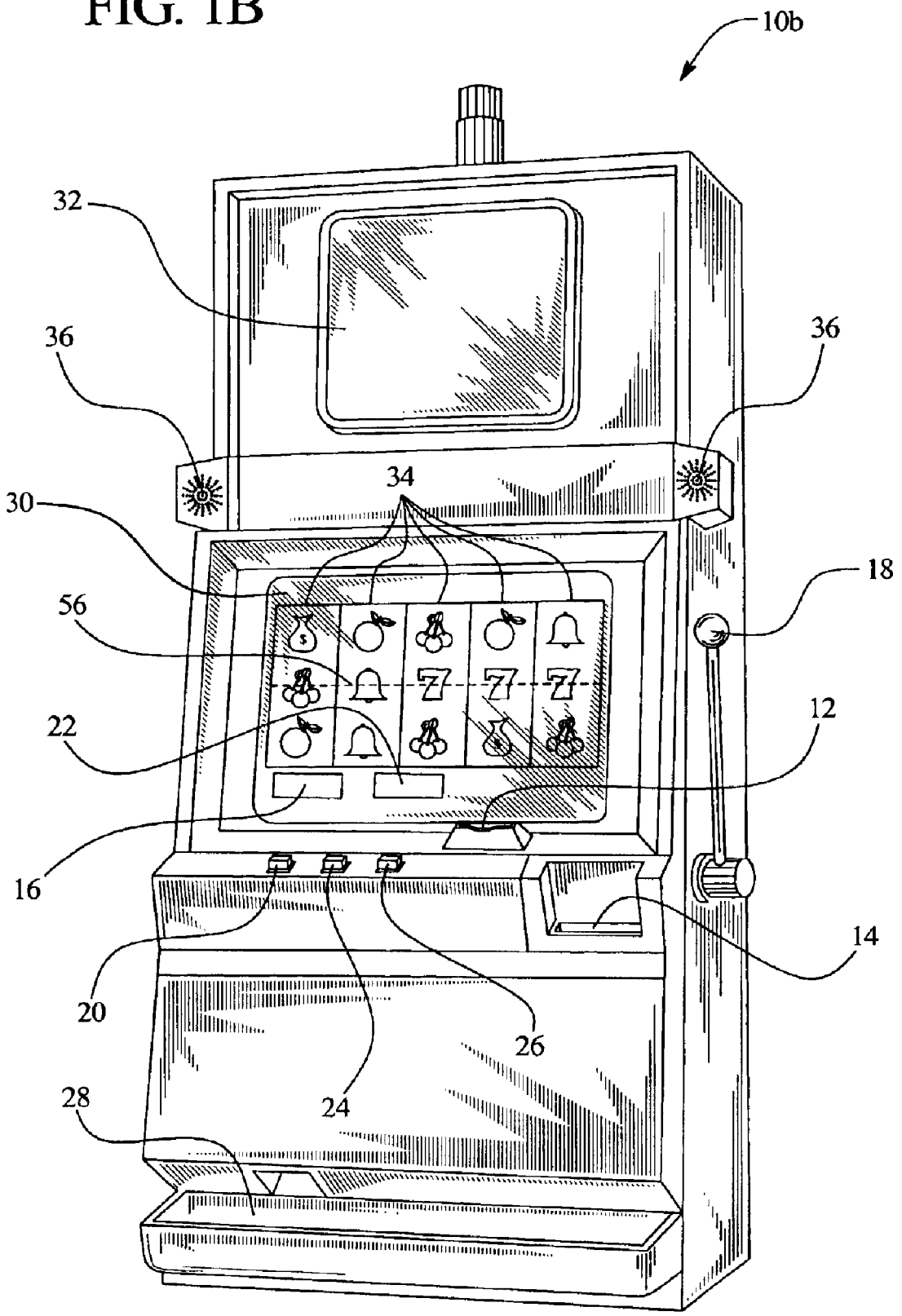

Referring now to the drawings, and in particular to FIGS. 1A and 1B, gaming device 10*a* and gaming device 10*b* illustrate two possible cabinet styles and display arrangements and are collectively referred to herein as gaming device 10. The present invention includes the game (described below) being a stand alone game or a bonus or secondary game that coordinates with a base game. When the game of the present invention is a bonus game, gaming device 10 in one base game is a slot machine having the controls, displays and features of a conventional slot machine, wherein the player operates the gaming device while standing or sitting. Gaming device 10 also includes being a pub-style or table-top game (not shown), which a player operates while sitting.

The base games of the gaming device 10 include slot, poker, blackjack and keno, among others. The gaming device 10 also embodies any bonus triggering events, bonus games as well as any progressive game coordinating with these base games. The symbols and indicia used for any of the base, bonus and progressive games include mechanical, electrical, electronic or video symbols and indicia.

In a stand alone or a bonus embodiment, the gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. A player may "cash out" by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 displays a plurality of reels 34, for example three to five reels 34, in mechanical or video form on one or more of the display devices. Each reel 34 displays a plurality of indicia such as bells, hearts, fruits, numbers, letters, bars or other images which correspond to a theme associated with the gaming device 10. If the reels 34 are in video form, the display device displaying the video reels 34 is a video monitor in one embodiment. Each base game, especially in the slot machine base game of the gaming device 10, includes speakers 36 for making sounds or playing music.

Figure 2:
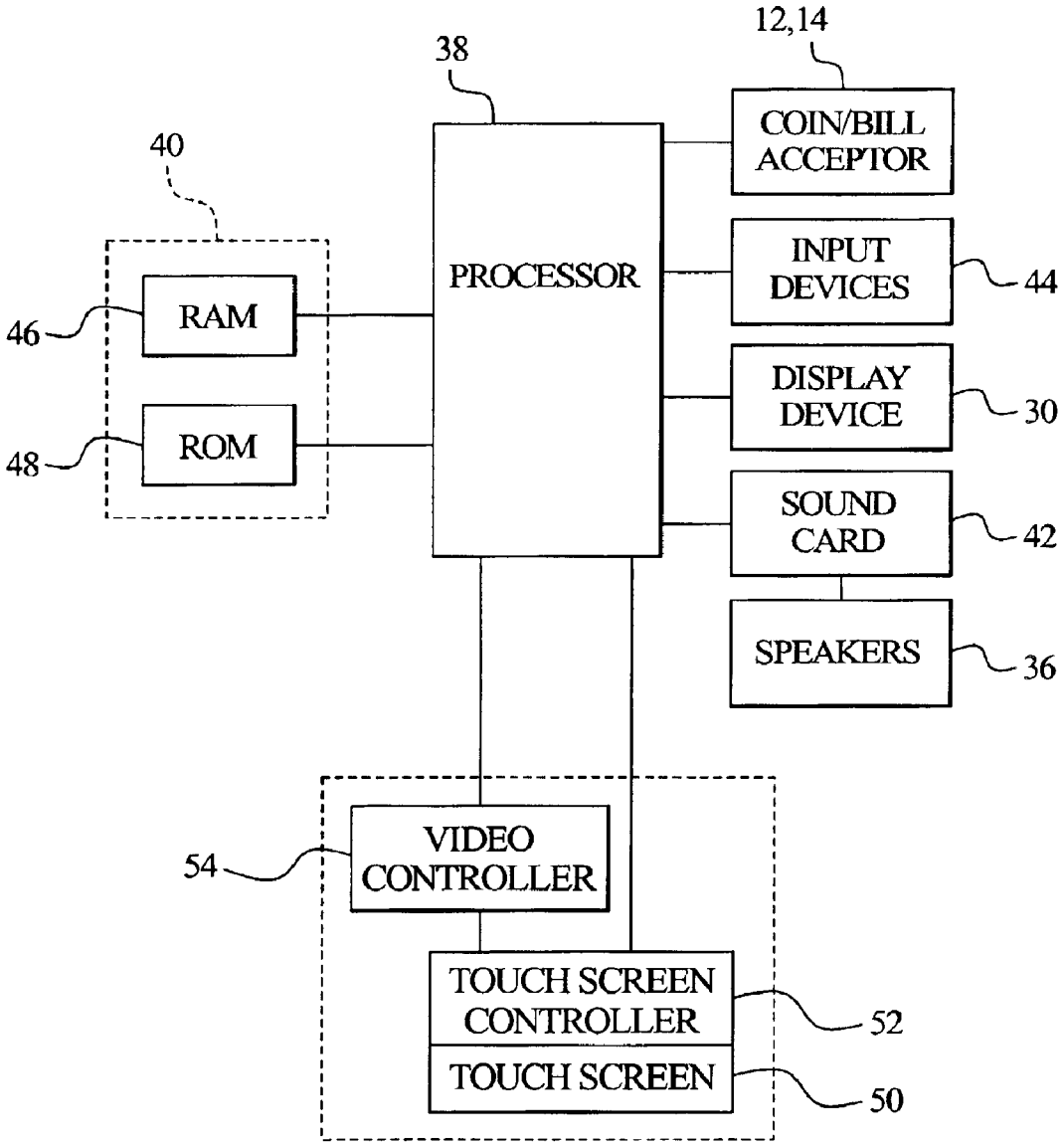
FIG. 2 is a schematic block diagram of the electronic configuration of one embodiment of the gaming device of the present invention.

Referring now to FIG. 2, one embodiment of an electronic configuration of the gaming device 10 for the stand alone and bonus embodiments described above includes: a processor 38; a memory device 40 for storing program code or other data; a central display device 30; an upper display device 32; a sound card 42; a plurality of speakers 36; and one or more input devices 44. The processor 38 is in one embodiment a microprocessor or microcontroller-based platform which is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively or alternatively referred to herein as a "processor"). Furthermore, although the processor 38 and memory device 40 reside in one embodiment in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 employs a video-based or mechanical display device 30 or 32 for the bonus games. The bonus games include a program that automatically begins when the player achieves a qualifying condition in the base game.

In the slot machine embodiment, the qualifying condition includes a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the present invention includes one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

Figure 3:
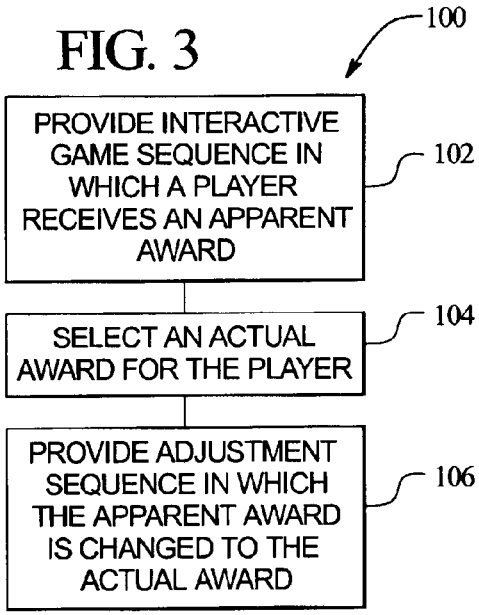
FIG. 3 is a schematic diagram generally illustrating the operation of the present invention.

Referring now to FIG. 3, a schematic diagram 100 generally illustrates the operation of the present invention. As indicated by the block 102, the gaming device provides an interactive game sequence in which a player receives an apparent award. That is, the player plays the game sequence, makes one or more selections during the sequence and receives an apparent award from the sequence. FIGS. 8A to 8E show one preferred embodiment of the game sequence of the present invention, however, the present invention includes any game sequence having one or more selections wherein the selection(s) yields an apparent award for the player. Alternatively, the present invention includes a game sequence in which gaming device 10 having a random generation device, such as a processor, randomly generates an apparent award for the player.

As indicated by block 104, at some point during the operation of the gaming device 10, an actual award is selected for the player. In one embodiment, the player's actions in the interactive game sequence yield or select the actual award for the player. In other embodiments, a random generation device, such as a processor, of the gaming device 10 generates the actual award for the player. In the latter case, it is possible that the processor 38 preselects the actual award for the player before the player plays the interactive game sequence.

As indicated by block 106, when the player has received an apparent award as indicated by block 102 and an actual award has been selected for the player as indicated by block 104, gaming device 10 provides an adjustment sequence in which the apparent award is changed to the actual award. In one preferred embodiment, the actual award is greater than the apparent award so that the adjustment sequence increases the apparent award. However, in alternative embodiments, gaming device 10 may raise or lower the apparent award to achieve the actual award. The adjustment in one embodiment occurs on one of the display devices 30 or 32 and includes dynamic video and/or audio displays that increase the apparent award to the actual award either in increments or all at once. The changing of the apparent award corresponds to a theme of the gaming device in one embodiment.

Figure 4:
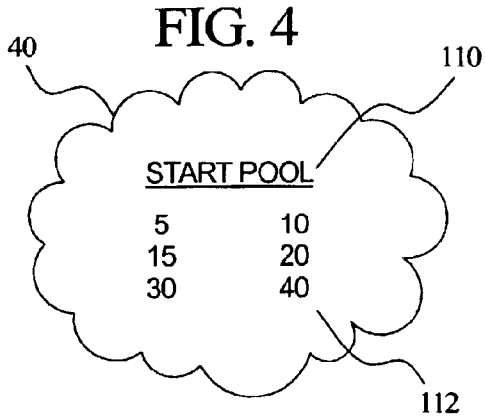
FIG. 4 is a schematic diagram illustrating a start value pool stored in a memory device of the present invention.

Referring now to FIG. 4, a schematic illustration of an area of the memory device 40 is illustrated having a start pool 110. The start pool 110 includes a plurality of start values 112. The start values in this example range from five credits to forty credits. The start values 12 may have any suitable range desired by the gaming device implementor. Although the start pool 110 contains six start values 112, the start pool 110 may include any suitable number of start values 112. The start values 112 may represent a number of credits or may represent an award modifier such as a multiplier. Alternatively still, the start values 112 can represent a number of picks from a prize pool or any other suitable item of value or opportunity to obtain a value.

Figure 5:
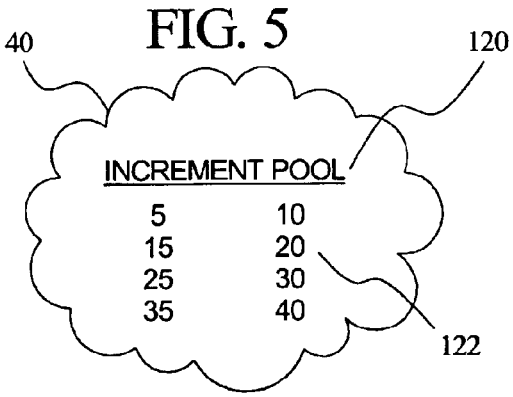
FIG. 5 is a schematic diagram illustrating an incremental value pool stored in a memory device of the present invention.

Referring now to FIG. 5, a schematic diagram of an area of the memory device 40 includes an increment pool 120 having a number of incremental values 122. The incremental values 122 again may stand for gaming device credits or other types of awards and represent, in one embodiment, the same type of award as the start values 112 of the start pool 110. Although the increment pool 120 contains eight incremental values 122, the increment pool 120 can have any suitable number of incremental values 122 desired by the gaming device implementor.

Figure 6:
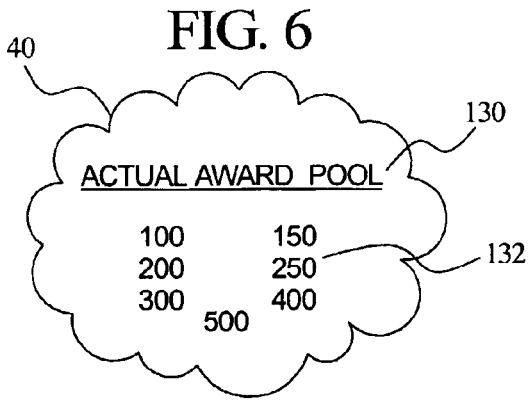
FIG. 6 is a schematic diagram illustrating an actual award pool stored in a memory device of the present invention.

Referring now to FIG. 6, a schematic diagram of an area of the memory device 40 includes an actual award pool 130. The actual award pool 130 includes a number of actual awards 132. The actual awards 132 may represent any suitable type of award including gaming device credits, however, the actual awards 132 represent the same type of item of value as the start values 112 and the incremental values 122. The actual award pool 130 can include any suitable number of actual awards 132 and is not limited to the seven awards illustrated. The actual award pool 130 can include any suitable range of actual awards desired by the implementor. The range of actual awards is in one embodiment higher on average than the range of the start values 112. The range of the increment pool 120 in one embodiment has an average value that enables any of the start values to be incremented by incremental values 122 several times before reaching one or more of the actual awards 132 of the actual award pool 130.

Figure 7:
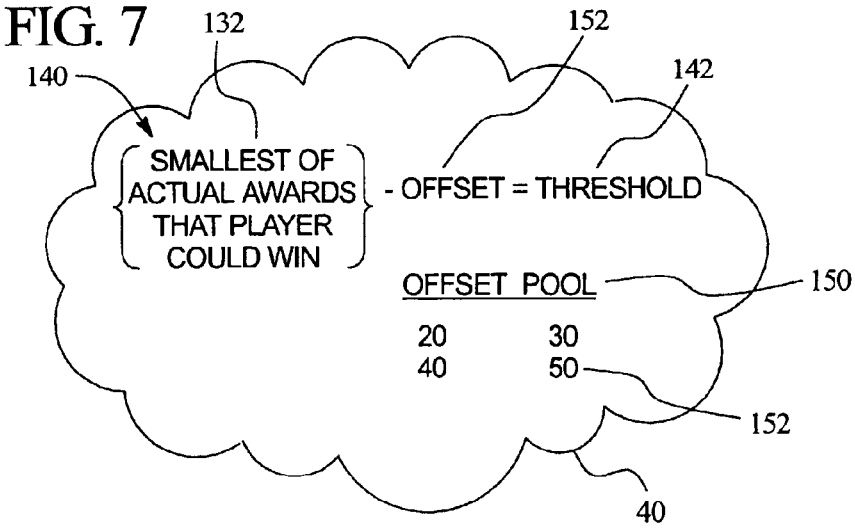
FIG. 7 is a schematic diagram illustrating an equation used for incrementing values and an offset value pool stored in a memory device of the present invention.

Referring now to FIG. 7, an area of the memory device 40 (or software instructions stored therein) includes an equation 140. The equation 140 determines a threshold value 142 that the gaming device uses to determine whether to increment a start value 112 with one of the incremental values 122. The equation 140 may take any suitable different form. In the illustrated embodiment, the equation 140 employs the smallest actual award 132 that the player could win less an offset value 152 to produce the threshold value 142.

FIG. 7 also illustrates an offset pool 150. The offset pool 150 includes a plurality of offset values 152. The offset pool 150 can include any number of different offset values 152. The offset values 152 may comprise any range desired by the implementor, however, the offset pool 150 includes values that when subtracted from the smallest actual award 132 of the actual award pool 130 enable at least some of the start values 112 of the start pool 110 to increment by at least some of the incremental values 122 before reaching the threshold value 142. That is, taking the smallest illustrated actual award 132 of one hundred less the largest illustrated offset value 152 of fifty yields a threshold value 142 of fifty. In this case, any of the start values 112 of the illustrated start pool 110 could increment by at least some of the incremental values 122 of the increment pool 120 before reaching the threshold 142.

In alternative embodiments, one or more of the pools previously illustrated may be replaced by a constant. For example, gaming device 10 can employ the same offset 152 in each trial, as illustrated below, instead of generating different offset values 152 from the offset pool 150. Further alternatively, gaming device 10 could employ a constant threshold 142. However, as will be illustrated, the threshold 142 depends on a select number of the actual awards 132 which can vary game sequence to game sequence. In other alternative embodiments, the start values 112 could be fixed instead of randomly chosen, as could the incremental values 122. To provide some award variation, however, gaming device 10 changes, in one embodiment, the actual awards 132 in each game sequence.

Referring now to FIGS. 8A through 8F, one embodiment of the operation of the gaming device 10 is illustrated. As stated above, the game sequence can include any type of player interactive sequence wherein the player selects an apparent award, and wherein the gaming device changes the apparent award to an actual award. Or, the interactive game sequence can randomly generate the apparent and/or actual award for the player. One point of the game sequence of the present invention is that the player plays for the apparent award, whereby the gaming device then switches the apparent award to an actual award which may have no relation to the player's luck in obtaining the apparent award. In this way, gaming device 10 can, as will be illustrated, present options to the player that are illogical yet make the player try to outthink or outguess the gaming device 10. In essence, the player's relative success in achieving an apparent award in the game sequence does not predict the success that the player has in achieving the actual award.

In FIGS. 8A to 8F, one preferred embodiment of the present invention is displayed on one of the display devices 30 or 32. For purposes of illustration, indicia, numbers and words or letters that the player sees at a given point in time are illustrated by the display device 30 or 32. Indicia, numbers and/or letters or words that the player does not see, but which are currently being processed or have recently been processed, are illustrated inside a cloud indicating an area of memory.

Figure 8A:
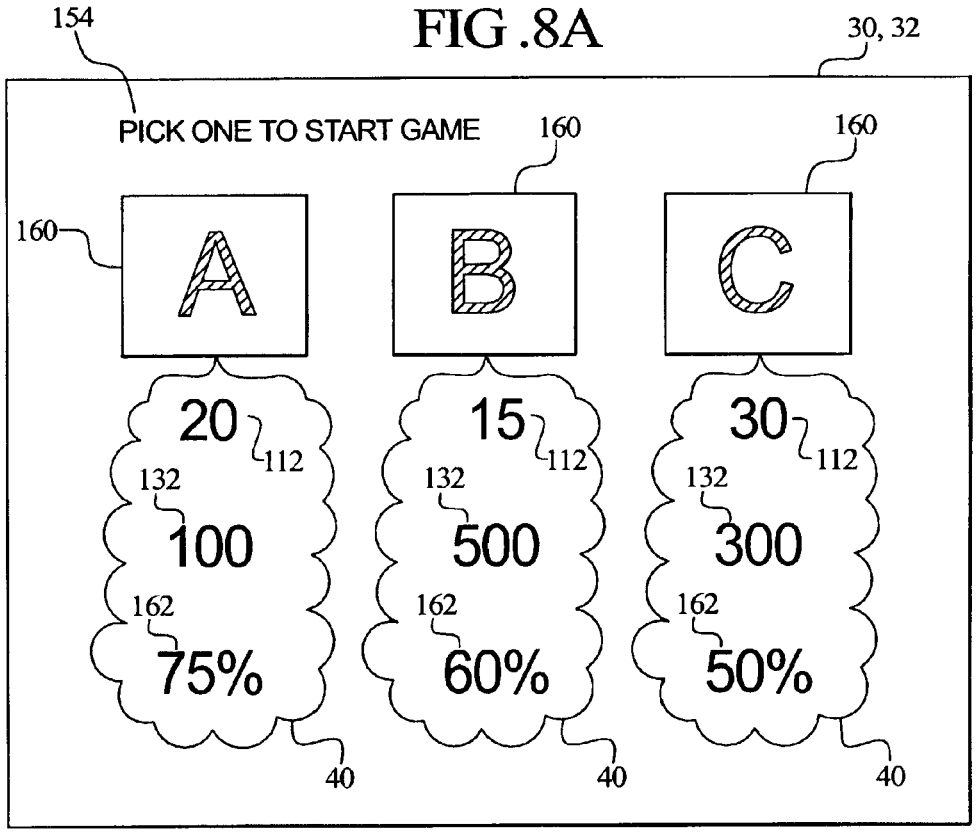
FIGS. 8A to 8F are elevation views of one of the display devices illustrating one keep or trade embodiment of the present invention.

FIG. 8A illustrates an initial screen that the player sees on one of the display devices 30 or 32. A video and/or audio message 154 prompts the player to pick one of three selections 160 to start the game sequence of the present invention. The illustrated embodiment includes three selections 160; namely, the "A" selection, the "B" selection and the "C" selection. It should be appreciated however that the present invention may include any suitable number of selections, including one selection and includes at least two selections 160 in one embodiment. In one preferred embodiment, the selections 160 are separate areas of the touch screen 50 that send a discrete input to the processor 38. In other embodiments, however, the selections 160 may be electromechanical pushbuttons that are mounted elsewhere on the cabinet of gaming device 10.

At some point prior to or immediately following the player's choice of one of the selections 160, the processor 38 in cooperation with one or more random generation devices randomly generates values from the start pool 110 and actual award pool 130. Gaming device 10 does not display the random generations to the player, otherwise the player would choose the selection yielding the highest actual award 132. In the illustrated screen of FIG. 8A, the gaming device 10 has randomly selected the start values 112 of twenty, fifteen and thirty for selections "A", "B" and "C" respectively. The gaming device 10 has randomly generated the actual awards 132 of one-hundred, five-hundred and three-hundred respectively for selections "A", "B" and "C".

Figure 8B:
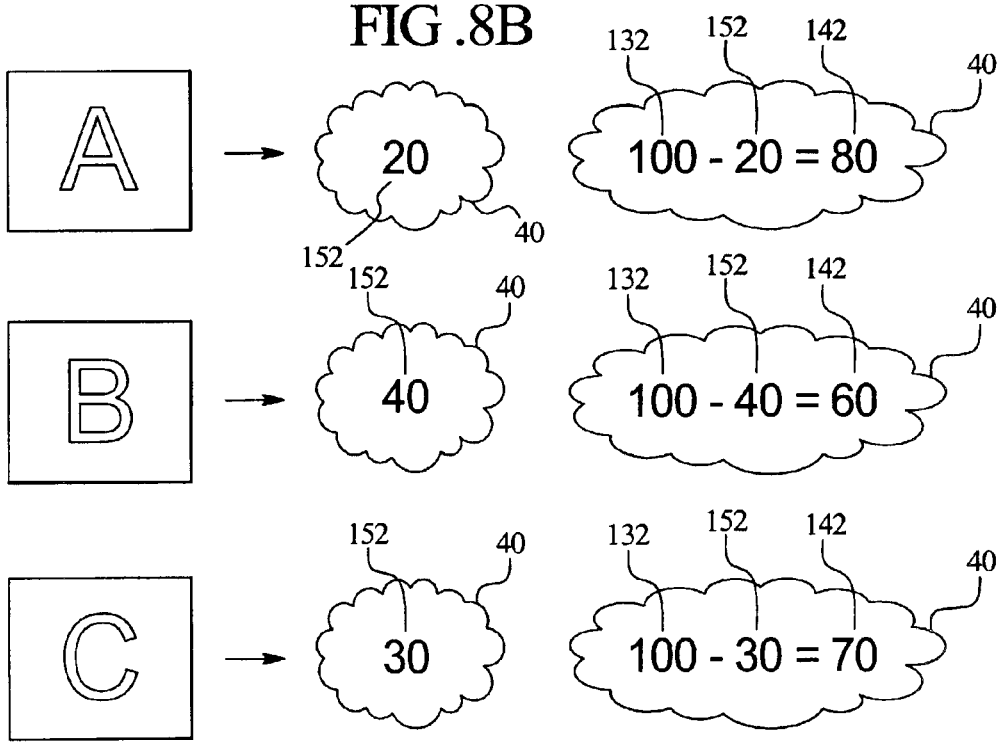

In the illustrated embodiment, the gaming device 10 performs a series of increments or trials in which the game may change and, for example, increase a selected start value 112. As illustrated in FIG. 8B, in order to determine whether to increment the start value, gaming device 10 first randomly chooses one of the offset values 152 from an offset pool 150 in the memory device 40. For the "A" selection 160, gaming device 10 randomly generates an offset value 152 of twenty. The gaming device then determines a threshold value 142 by selecting the smallest of the actual awards 132 that the player could win, which in this case is the one-hundred value in association with the "A" selection 160. The equation 140 subtracts the offset value 152 from the smallest actual award 132 to yield a threshold value 142 of eighty. Using the smallest of the actual awards 132 ensures that the incremented values will always be less than the smallest actual award 132. This ensures that the player's apparent award will always be less than the actual award ultimately provided to the player. In a similar manner for the "B" selection 160, gaming device 10 generates an offset value 152 of forty to create a threshold value 142 of sixty. For the "C" selection 160, gaming device 10 generates an offset value 152 of thirty and threshold value 142 of seventy.

As will be illustrated, in order to increment the start value 112 for any of the selections 160, two conditions must be met. First, the incremented value must be less than a threshold value 142 as will be illustrated below. Also, each selection 160 includes an associated likelihood of generation percentage 162 as seen in FIG. 8A. The generation percentage 162 sets the likelihood that the incremented value, if less than the threshold, will be provided to the player. For example, if the start value 112 of twenty is incremented to a value less than the threshold 142, there is, as seen in FIG. 8A, a 75% chance for selection A that gaming device 10 provides the incremented value to the player. The "B" selection 160 has an associated 60% chance of incrementing the start value 112. The "C" selection 160 has a 50% chance of incrementing the start value 112.

Gaming device 10 can set the percentages 162 at any desired amount and in any desired arrangement. That is, the percentages do not have to decrease from selection "A" to selection "C" as illustrated. The percentages 162 in an alternative embodiment may be randomly generated or may be the same for each selection 160. Further alternatively, the game may not employ a percentage 162.

Figure 8C:
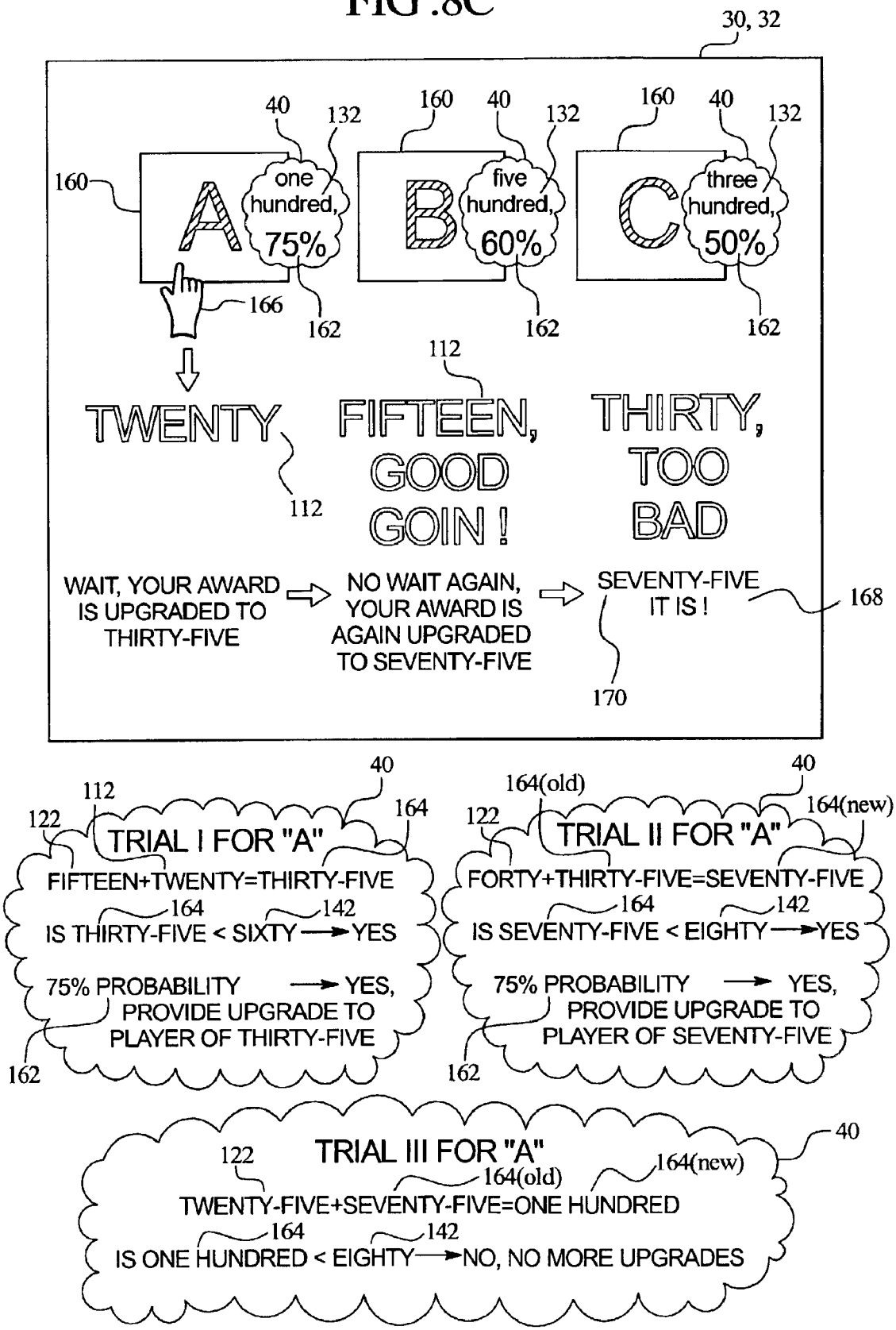

Referring now to FIG. 8C, when the player 166 selects one of the selections 160, here, the "A" selection 160, gaming device 10 reveals the start values 112 to the player. That is, gaming device 10 reveals that the player's choice of the selection 160 has resulted in a start value 112 of twenty. Further, the gaming device 10 informs the player that choosing selection "B" would have resulted in a start value 112 of fifteen, and that choosing selection "C" would have resulted in a start value 112 of thirty. The player therefore feels good at this point in the game because the player has chosen a selection 160 that has yielded the second largest start value 112.

FIG. 8C illustrates a number of trials or increments (Trials I to III) in memory 40, which are hidden from the player except for the resulting incremented value 164 and the resulting apparent award 170. In Trial I, gaming device 10 generates randomly an incremental value 122 of fifteen from the increment pool 120 and adds to it the start value 112 of twenty, which totals a possible incremented value 164 of thirty-five. Gaming device 10 compares the possible incremented value 164 with the threshold value 142 of eighty. Since the possible incremented value of thirty-five is less than eighty, gaming device 10 randomly generates whether to provide the possible incremented value to the player using the 75% chance percentage 162. In this example, the gaming device generates that the player receives the incremented value 164 of thirty-five and indicates the same visually on display device 30 or 32 and/or audibly via speakers 36.

In Trial II, gaming device 10 repeats the above sequence using an incremental value of 122 of forty. The gaming device adds the incremented value 164 of thirty-five to the incremental value 122 to produce a new possible incremented value of seventy-five. Since seventy-five is less than the threshold value 142 of eighty, gaming device 10 applies the 75% chance random determination. In this example, the gaming device again determines that the player receives the new incremented value 164 of seventy-five and displays the same visually on the display device 30 or 32 and/or audibly via speakers 36.

Gaming device 10 in one preferred embodiment repeats this process until: (i) the possible incremented value exceeds the threshold value 142; or (ii) the game randomly determines, using the likelihood percentage 162, not to provide the possible incremented value to the player. In Trial III, gaming device 10 randomly generates the twenty-five incremental value 122 from the increment pool 120 and adds the twenty-five to the incremented value 164 of seventy-five to yield a new potential incremented value of one-hundred. Because one-hundred is greater than the threshold value 142 of eighty, gaming device 10 provides a visual, audio or audiovisual message 168 to the player specifying that the player's apparent award 170 is the last properly incremented value of seventy-five.

In an alternative embodiment, gaming device 10 can increase the apparent award 170 to the associated actual award 132 (shown in FIG. 8A) of one hundred. In such a case the gaming device would increase the apparent award through a video or audiovisual sequence on the display device 30 or 32 and provide the actual award 132 to the player. Thereafter, the game sequence of the gaming device 10 would end. In one preferred embodiment, however, gaming device 10 includes one or more keep or trade sequences that provide the player with the opportunity to either keep the current apparent award 170 or trade the apparent award for another award or apparent award 170. In the illustrated embodiment, gaming device 10 determines the awards or apparent awards with which to offer to the player by upgrading or incrementing the unselected start values 112 in the same manner as gaming device 10 has incremented the player's start value 112.

In various alternative embodiments, gaming device 10 provides the keep or trade sequence during the incrementing of the selected start value towards the apparent award. Here, gaming device 10 can increment the selected start value after the player selects to keep or trade the selected start value. Further, gaming device 10 can increment one of the unselected start values after the player selects to keep or trade the selected start value. Still further, gaming device 10 can decrease the start value before or after the player selects to keep or trade the selected start value. Further, gaming device 10 can decrease one of the unselected start values before or after the player selects to keep or trade the selected start value. In any of the foregoing alternatives, the player can trade back for the originally selected start value or an incremented variation thereof, from a value for which the player has previously traded.

Figure 8D:
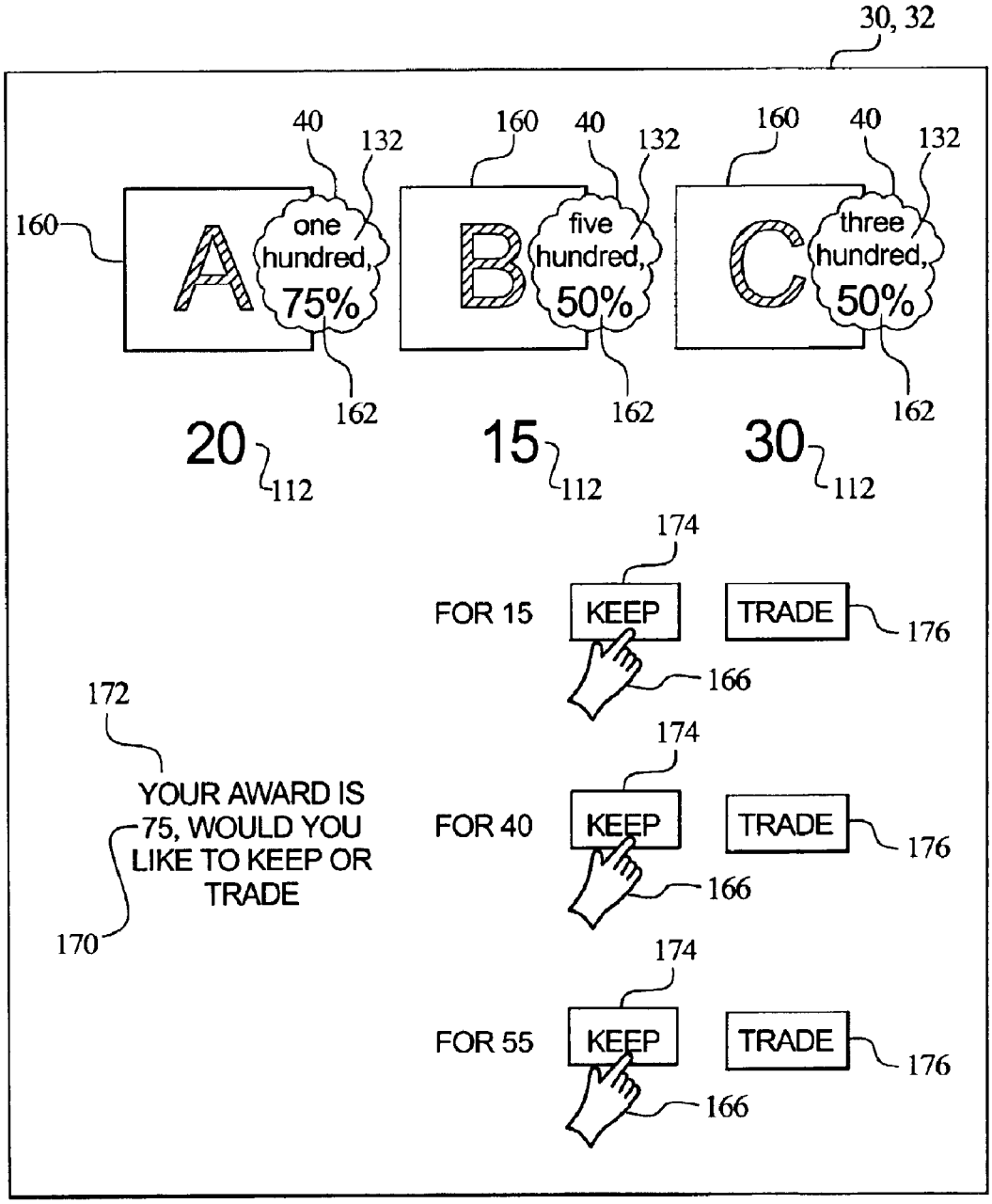

Referring now to FIGS. 8B and 8D, in a first keep or trade sequence, gaming device 10 randomly selects a new offset value 152 of forty in an area of the memory device 40 as illustrated below the display device 30 or 32. The gaming device uses the new offset value 152 to determine a new threshold value 142 via the equation 140 and the smallest actual award 132 of one hundred. The new threshold value 142 is calculated to be sixty. In an alternative embodiment, the threshold value 142 remains constant in the keep or trade sequence. After determining the new threshold value 142, gaming device 10 provides a message 172 to the player informing the player that the current award is seventy-five and asks the player to keep or trade the value seventy-five for another value.

FIG. 8D illustrates one embodiment, wherein the gaming device 10 enables the player to keep or trade the current apparent award 170 at various times while another start value 112 is being incremented. FIG. 8D illustrates that gaming device 10 enables the player to keep the apparent award 170 of seventy-five or trade it for the start value 112 of fifteen associated with the "B" selection 160. The player 166 decides to keep the apparent award by selecting a keep button 174. The gaming device provides a simulated keep button 174 and a simulated trade button 176, which are separate areas of the touch screen 50 that send a discrete input to the processor 38 of the gaming device 10. Alternatively, keep button 174 and trade button 176 are separate electromechanical pushbuttons that mount to an area of the cabinet of the gaming device 10.

Upon keeping the apparent award 170, gaming device 10 increments the start value 112 of fifteen to an incremented value of forty and offers the forty value in exchange for the apparent award 170. Because the apparent award 170 of seventy-five is greater than the incremented value of forty, the player 166 decides to keep the apparent award 170 by selecting the keep button 174. Gaming device 10 continues to increment the start value 112 associated with the selection "B" until one of the conditions described above is not met. The gaming device 10 again increases the start value 112 to fifty-five, and the player again keeps the apparent award 170 associated with the selection "A" because the apparent award 170 of "A" is larger than fifty-five. For reference, FIG. 8D continues to show the actual awards 132 in phantom as well as the percentages 162.

It should be appreciated that the embodiment of the gaming device in FIG. 8D makes several illogical offers to the player. The player in the illustrated embodiment chooses to keep the higher obtained award. However, the player may be tempted to wonder why the gaming device 10 is offering a lower award and in fact trade for the lower award thinking that gaming device 10 may increase the award or otherwise provide a higher award than the player currently has. In fact, the actual award associated with the selection "A" is only one-hundred, while the actual award 132 associated with the selection "B" is five-hundred. Therefore the suspicious player who decides to trade for one of the lower incremented awards would in this example obtain a higher actual award 132.

Figure 8E:
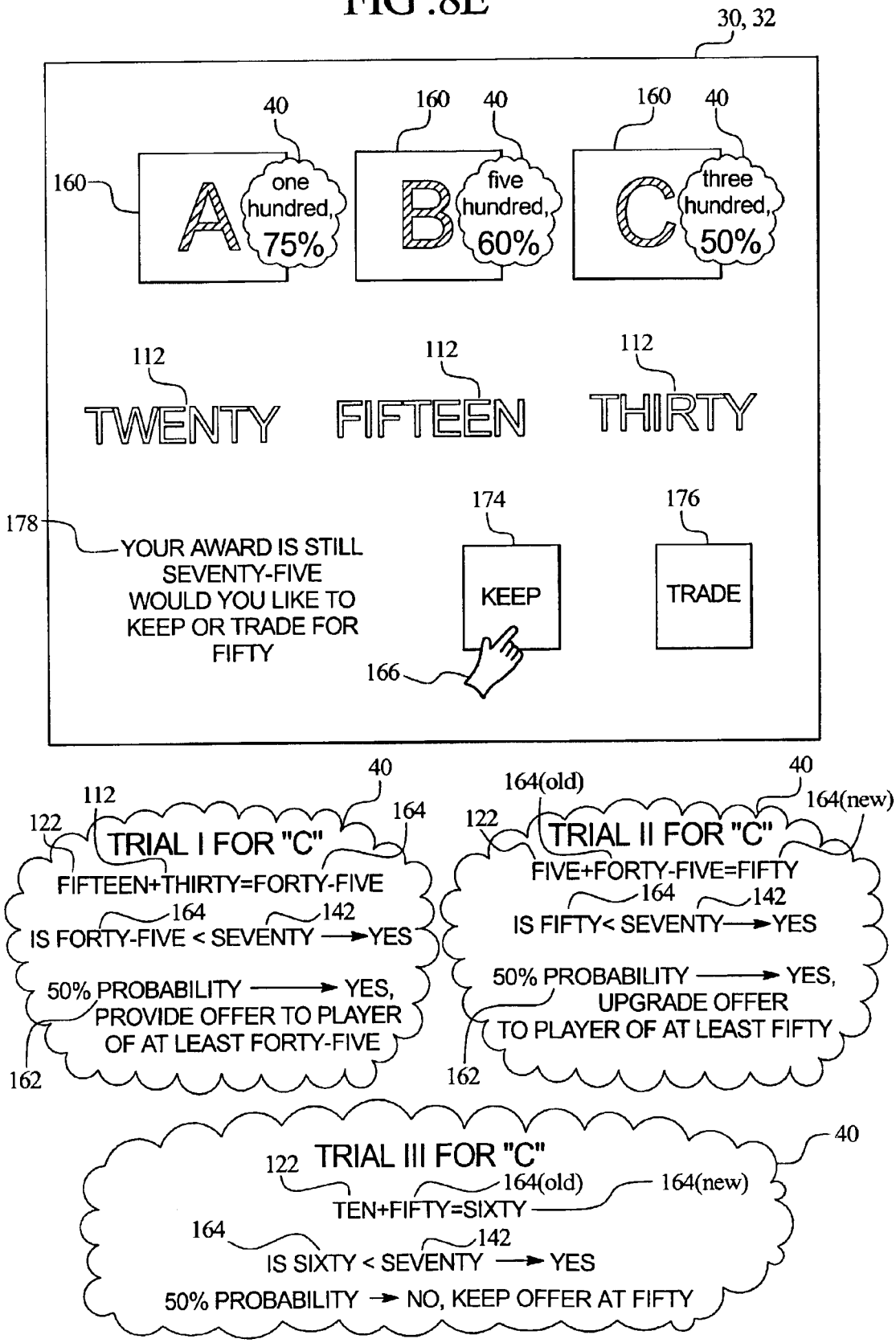

Referring now to FIGS. 8B and 8E, gaming device 10 performs the above described incrementing process for the "C" selection 160. Gaming device 10 again determines a new offset value 152 in the memory device 40 and a new threshold value 142 of seventy in the memory device 40 as illustrated below the display device 30 or 32 in FIG. 8B. Gaming device 10 determines the threshold value 142 according to the equation 140 and the smallest actual value 132 of one hundred. For reference, the actual awards 132 and the likelihood percentages 162 are illustrated in phantom. In the embodiments disclosed in FIGS. 8A to 8E, the percentages 162 decrease as the player proceeds through the game sequence. In one preferred embodiment, the percentages decrease as the game continues. Therefore, in one embodiment, the gaming device associates the percentages 162 with the order in which the gaming device 10 increments each of the selections 160. That is, if the player were to initially choose the "B" selection 160, gaming device 10 would initially employ the highest percentage 162 of seventy-five in association with the selection "B". The gaming device 10 would associate the second largest percentage 162 with the second selection 160 and the lowest percentage 162 with the third selection 160.

Gaming device 10 provides an audio or audiovisual message 178 that informs the player that the player's current award is still seventy-five. FIG. 8E illustrates an alternative keep or trade embodiment to FIG. 8D, wherein gaming device 10 only provides the ultimate apparent award from the selection "C" to the player as a keep or trade option, rather than providing the option each time the start value 112 of the selection "C" is incremented.

In Trial I for "C", gaming device 10 increments the start value 112 of thirty for the selection "C" a number of times using the method disclosed above. The gaming device generates an incremental value 122 of fifteen and adds the incremental value to the start value 112 of thirty to yield a potential incremented value of forty-five, which is less than the new threshold value 142 of seventy. The gaming device employs a 50% probability 162 and determines to provide the incremented value 164 of forty-five to the player.

In Trial II, the gaming device generates an incremental value 122 of five and adds it to the incremented value 164 of forty-five to yield a new potential incremented value of fifty, which is less than the threshold value of seventy. Gaming device 10 employs the probability 162 of fifty and again determines to provide the incremented award 164 of fifty to the player.

In Trial III for "C", the gaming device generates a new incremental value 122 of ten and adds it to the currently incremented value 164 of fifty to yield a new potential incremented value of sixty, which is less than the threshold value of seventy. In this case, however, gaming device 10 employs the 50% probability 162 and randomly determines not to provide the potential incremented value of sixty to the player. Therefore, the apparent award 170 for the "C" selection 160 is fifty and is offered to the player in trade for the player's current award 170 of seventy-five. In this case, the player again decides to keep the current award by pressing the keep button 174 as illustrated.

Figure 8F:
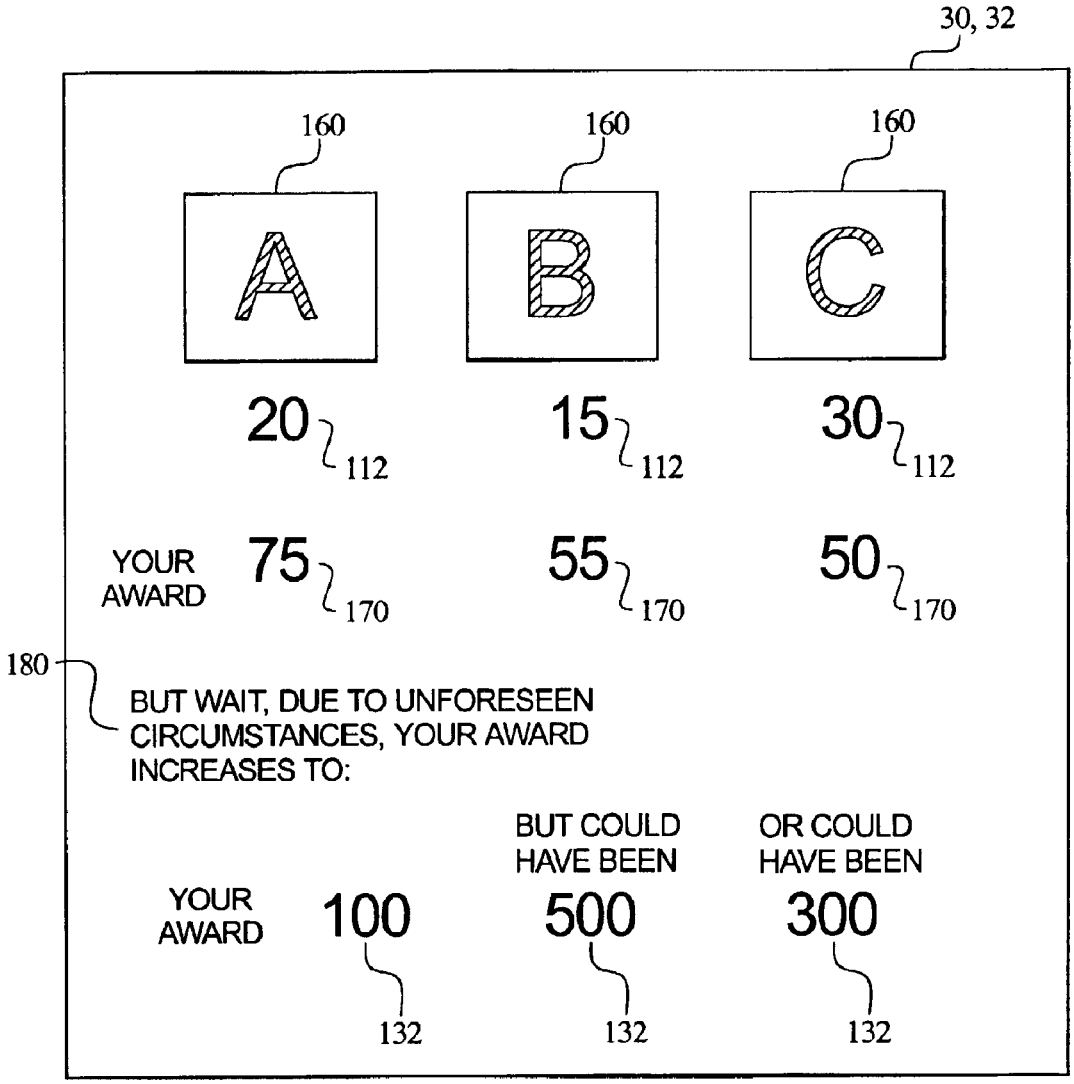

Referring now to FIG. 8F, upon sequencing through each of the selections 160, the player winds up with an apparent award 170 of seventy-five. Gaming device 10 also displays the apparent values associated with the selections 160 of "B" and "C"; namely, the apparent awards 170 of fifty-five and fifty respectively. At this point, the player feels good because the player has selected the highest apparent award 170.

However, as illustrated in FIG. 8F, gaming device 10 provides an audio or audiovisual message 180 that informs the player that due to unforeseen circumstances the apparent awards all increase. In one preferred embodiment, the apparent awards 170 change or increase to the actual awards 132 associated with the selections 160. Gaming device 10 performs an adjustment sequence in which the apparent awards may be stepped up incrementally to the actual awards or the actual awards 132 may be displayed at once. For purposes of illustration, FIG. 8F simply shows the actual awards for each of the selections 160.

The player's apparent award of seventy-five increases to an actual award 132 of one-hundred. The player is happy to receive more credits, however, the apparent award 170 of fifty-five associated with the selection "B" increases to five-hundred and the apparent award of fifty associated with the selection "C" increased to three-hundred. If the player had traded the apparent award associated with the selection "A" for either of the apparent awards associated with the selections "B" or "C", even though these apparent awards were less than the apparent award associated with selection "A", the player would have ultimately received a higher actual award 132.

The actual awards 132 are randomly associated with the apparent awards 170 in one embodiment. In the above example, the smallest apparent award fifty-five was associated with the largest actual award, five hundred. The largest apparent award seventy-five was associated with the smallest actual award, one hundred. These values were chosen to illustrate the illogical results of the present invention. The reverse association could have instead randomly taken place, namely, wherein the smallest apparent award is associated with the smallest actual award and the largest apparent award is associated with the largest actual award. The intermediate apparent award could be randomly associated with the largest or smallest actual award. The randomness of the game will add to the illogical results of the game. The game is thus completely random, and does not introduce any element of player skill.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

an interactive game sequence in which a player achieves one of a plurality of apparent awards, wherein each of said plurality of awards has a value greater than zero and each of said plurality of apparent awards cannot be provided to the player;

a plurality of actual awards, wherein each of said plurality of actual awards has a value greater than zero and at least one of said actual awards has a value greater than at least one of said apparent awards; and an adjustment sequence, wherein upon a selection made by the player, said apparent award is replaced by one of the actual awards, wherein the actual award is provided to the player.

2. The gaming device of claim 1, wherein the actual award provided to the player is generated randomly and is unrelated to the apparent award achieved by the player.

3. The gaming device of claim 1, wherein at least one other of the apparent awards is revealed to but not provided to the player.

4. The gaming device of claim 1, wherein the plurality of actual awards are selected from a pool of actual awards.

5. The gaming device of claim 1, wherein the interactive game sequence includes a plurality of start values, wherein one of the start values is selected for the player.

6. The gaming device of claim 5, wherein the start value selected for the player is an outcome of a selection by the player.

7. The gaming device of claim 5, wherein each of the plurality of start values is associated with one of the actual awards.

8. The gaming device of claim 1, wherein the interactive game sequence includes at least one keep or trade option for the player.

9. The gaming device of claim 1, wherein at least one selection by the player in the interactive game sequence determines which one of a plurality of start values is selected for the player, the start value becoming the apparent award achieved by the player.

10. The gaming device of claim 1, wherein at least one keep or trade option in the interactive game sequence determines the actual award achieved by the player.

11. The gaming device of claim 1, wherein the actual awards are each larger than the apparent award achieved by the player.

12. The gaming device of claim 1, wherein the apparent awards are revealed to the player and the adjustment sequence includes each revealed apparent award being replaced by one of actual awards.

13. A gaming device:

a plurality of displayed start values;

a plurality of displayed apparent awards, each apparent award derived through a game sequence from one of the plurality of start values, wherein each of said apparent awards has a value greater than zero and each of said plurality of apparent awards cannot be provided to a player; and an actual award provided to the player, the actual award selected from a plurality of actual awards which are unrelated to the apparent awards, wherein each of said actual awards has a value greater than zero, at least one of said actual awards has a value greater than at least one of said apparent awards and said actual award is displayed by replacing one of the apparent awards.

14. The gaming device of claim 13, which includes a plurality of incremental values, wherein at least one of the incremental values increments one of the start values to one of the apparent awards.

15. The gaming device of claim 13, wherein one of the start values is incremented by an incremental value if a resulting incremented value is below a threshold value.

16. The gaming device of claim 15, wherein the incremented value is provided to the player a predetermined percentage of the time.

17. The gaming device of claim 15, wherein the threshold value equals the actual award less an offset value.

18. The gaming device of claim 13, wherein one of the apparent awards appears to be provided to the player, the apparent award determined by at least one keep or trade option, wherein the player can keep a first one of the apparent awards, which is incremented from a first one of the start values, or trade the first apparent award for a second one of the apparent awards, which is incremented from a second one of the start values.

19. A gaming device comprising:

a processor;

a display device; and a memory device storing a program, the program executable by the processor to:

(a) cause the display device to display a start value, (b) enable a player to keep the start value or trade the start value for a second value, a selected one of which becoming an apparent award, said apparent award having a value greater than zero, wherein said apparent award cannot be provided to the player, (c) replace said apparent award with an actual award unrelated to said apparent award, said actual award having a value greater than said apparent award, and (d) provide the actual award to the player.

20. The gaming device of claim 19, wherein the start value is a first start value and the second value is incremented from a second start value.

21. The gaming device of claim 19, wherein the processor is operable to increment the start value and enable the player to keep or trade the incremented start value for the second value.

22. The gaming device of claim 19, wherein the processor is operable to increment the start value after the player keeps the incremented start value.

23. The gaming device of claim 19, which includes a plurality of displayed start values, wherein the start value is a first start value and which includes a second start value, the second start value incremented after the player keeps the first start value, wherein the player is provided an opportunity to keep or trade the first start value for the incremented second start value.

24. The gaming device of claim 19, wherein the processor is operable to increment the start value after the player trades the start value, wherein the player is provided an opportunity to trade back for the incremented second start value.

25. The gaming device of claim 19, wherein the processor is operable to increment the start value, enable the player to keep or trade the incremented start value for the second value and enable the player to trade back for the incremented start value after trading for the second value.

26. A bonus game of a gaming device comprising:

a first value greater than zero displayed to a player;

a keep or trade sequence that enables the player to keep the first value or trade the first value for a displayed second value greater than zero, the selected first or second value is displayed as an apparent award, wherein the apparent award cannot be provided to the player; and an actual award provided to the player in place of the apparent award, wherein said actual award is unrelated to the first and second values and said actual award has a value greater than at least one of said first value or said second value.

27. The bonus game of claim 26, wherein the first value is modified prior to the keep or trade sequence.

28. The bonus game of claim 26, wherein at least one of the first and second values is modified via a sequence of operations using at least one mathematical equation.

29. The bonus game of claim 26, wherein the actual award is associated with the first or second value, whichever is kept by the player.

30. The bonus game of claim 26, which includes a plurality of said keep or trade sequences.

31. The bonus game of claim 30, wherein the player advances through the keep or trade sequences until the player trades the first value.

32. The bonus game of claim 26, which includes a plurality of selections displayed to the player, wherein the first value is associated with one of the selections selected by the player.

33. The bonus game of claim 26, wherein the second value is based on an initially displayed value associated with one of the selections not chosen by the player.

34. A gaming device comprising:

a plurality of actual awards, wherein each of said plurality of actual awards has a value which is greater than zero and one of the actual awards is provided to a player;

an interactive game sequence in which the player appears to achieve an apparent award which has a value less than at least one of said actual awards, wherein said apparent award cannot be provided to the player;

an adjustment sequence in which said apparent award is revealed to the player and then replaced by the actual award provided to the player; and wherein the apparent award is generated independent of the actual award.

35. The gaming device of claim 34, wherein at least one selection by the player in the interactive game sequence determines the apparent award achieved by the player.

36. The gaming device of claim 34, wherein at least one keep or trade option in the interactive game sequence determines the actual award achieved by the player.

37. A gaming device comprising:

a plurality of actual awards, wherein each of said actual awards has a value greater than zero and one of the actual awards is provided to a player;

an interactive game sequence in which the player appears to achieve one of a plurality of apparent awards, wherein each of said apparent awards has a value greater than zero, at least one of said apparent awards has a value less than at least one of said actual awards and each of said plurality of apparent awards cannot be provided to the player;

a keep or trade sequence in which the player keeps the apparent award or trades the apparent award for one or more other apparent awards; and an adjustment sequence in which the selected apparent award is revealed to the player and then replaced by one of said actual awards which is unrelated to the selected apparent award.

38. The gaming device of claim 37, wherein the apparent award is generated from a source independent from a source from which the actual award is generated.

39. A method of operating a gaming device comprising the steps of:

(a) selecting an actual award for a player from pool of actual awards, wherein each of said actual awards has a value greater than zero;

(b) displaying an apparent award to the player, the apparent award derived independently from the actual award, wherein said apparent award has a value greater than zero, said apparent award has a value less than said actual award and said apparent award cannot be provided to the player;

(c) providing a game sequence that changes the apparent award to the actual award; and (d) providing the actual award to the player.

40. The method of claim 39, which includes providing a plurality of possible apparent and actual awards, and wherein the apparent award displayed to the player and the actual award provided to the player are unrelated.

41. A method of operating a gaming device comprising the steps of:

(a) providing a start value greater than zero to a player;

(b) enabling the player to keep the start value or trade the start value for a second value greater than zero, wherein the value selected by the player becomes an apparent award for the player, wherein said apparent award cannot be provided to the player;

(c) changing the apparent award to an actual award unrelated to the apparent award, wherein the actual award has a value greater than said apparent award; and (d) providing the actual award to the player.

42. The method of claim 41, which includes the step of incrementing the start value prior to enabling the player to keep or trade the start value.

43. The method of claim 41, which includes providing steps (a) to (ed) through a data network.

44. The method of claim 43, wherein the data network includes an internet.

45. A method of operating a gaming device comprising the steps of:

(a) providing a first value greater than zero to a player;

(b) performing at least one keep or trade sequence that enables the player to keep the first value or trade the first value for at least one other value greater than zero, wherein said kept value cannot be provided to the player; and (c) providing an award to the player in place of the first value or one of the other values, whichever is kept by the player wherein the award is determined independently from the values and said award has a value greater than said values.

46. The method of claim 45, which includes the step of associating awards individually with each of the first value and the other values, wherein the award provided to the player is associated with the first value or one of the other values, whichever is kept by the player.

47. The method of claim 45, which includes the step of modifying the first value prior to the keep or trade sequences.

48. The method of claim 47, which includes the step of modifying the first value using a mathematical equation.

49. The method of claim 47, which includes the step of modifying the other value prior to enabling the player to keep or trade the first value.

50. The method of claim 47, which includes the step of modifying the first value until a threshold value is reached.

51. The method of claim 50, wherein the threshold value is dependent on the smallest of a plurality of initially displayed values, the values including the first value.

52. The method of claim 50, which includes the step of determining the threshold value using an offset value.

53. The method of claim 50, which includes the step of determining the offset value randomly.

54. The method of claim 50, which includes using a randomly determined probability in combination with the threshold value in determining when to stop modifying the first value.

55. The method of claim 47, wherein modifying includes increasing or decreasing the first value.

56. The method of claim 45, which includes providing steps (a) to (c) through a data network.

57. The method of claim 56, wherein the data network includes an internet.

58. A method of operating a gaming device comprising the steps of:

(a) providing a plurality of selections to a player;

(b) generating an initial value greater than zero for the player based on the selection picked by the player;

(c) incrementing the initial value until a threshold value is reached or until a probability determination generates a stop incrementing outcome;

(d) enabling the player to keep the incremental initial value or trade it for at least one alternative value associated with one of the selections to form a kept value, wherein the incremental initial value or the kept value cannot be provided to the player;

(e) upgrading the kept value to an award value which is associated with the selection associated with the kept value, wherein the award value is greater than said kept value; and (f) providing the award value to the player.

59. The method of claim 58, which includes an initial value displayed in association with each of the selections, wherein the threshold value is dependent on the smallest of the initial values displayed.

60. The method of claim 58, which includes determining the threshold value using an offset value.

61. The bonus game of claim 26, wherein the second value is modified before the keep or trade sequence.

* * * * *

UNITED STATES PATENT AND TRADEMARK OFFICE

CERTIFICATE OF CORRECTION

PATENT NO. : 7,001,278 B2
APPLICATION NO. : 10/269424
DATED : February 21, 2006
INVENTOR(S) : Darren Maya et al.

It is certified that error appears in the above-identified patent and that said Letters Patent is hereby corrected as shown below:

In Claim 43, column 18, line 12, change "(ed)" to --(d)--.

Signed and Sealed this

Fourth Day of July, 2006

JON W. DUDAS
*Director of the United States Patent and Trademark Office*

UNITED STATES PATENT AND TRADEMARK OFFICE

CERTIFICATE OF CORRECTION

PATENT NO. : 7,001,278 B2
APPLICATION NO. : 10/269427
DATED : February 21, 2006
INVENTOR(S) : Darren Maya et al.

It is certified that error appears in the above-identified patent and that said Letters Patent is hereby corrected as shown below:

In Claim 43, column 18, line 12, change "(ed)" to --(d)--.

This certificate supersedes Certificate of Correction issued July 4, 2006.

Signed and Sealed this

First Day of August, 2006

JON W. DUDAS
*Director of the United States Patent and Trademark Office*